US007586732B2

(12) United States Patent
Myers

(10) Patent No.: US 7,586,732 B2
(45) Date of Patent: Sep. 8, 2009

(54) REMOTE CONTROLLED LOCKING ELECTROSHOCK STUN DEVICE AND METHODS OF USE

(75) Inventor: Steven Bradley Myers, Denver, CO (US)

(73) Assignee: Steven B. Myers, Denver, CO (US)

( * ) Notice: Subject to any disclaimer, the term of this patent is extended or adjusted under 35 U.S.C. 154(b) by 4 days.

(21) Appl. No.: 11/733,738

(22) Filed: Apr. 10, 2007

(65) Prior Publication Data

US 2007/0183115 A1 Aug. 9, 2007

Related U.S. Application Data

(63) Continuation-in-part of application No. 11/294,205, filed on Dec. 6, 2005, now abandoned, and a continuation-in-part of application No. 11/117,029, filed on Apr. 29, 2005, now abandoned.

(51) Int. Cl.
*F41B 15/04* (2006.01)
*H01T 23/00* (2006.01)

(52) U.S. Cl. ..... 361/232

(58) Field of Classification Search ..... None
See application file for complete search history.

(56) References Cited

U.S. PATENT DOCUMENTS 4,089,195 A * 5/1978 Lai ..... 70/16
5,463,884 A * 11/1995 Woo et al. ..... 70/16
6,933,851 B2 * 8/2005 Hahne et al. ..... 340/573.4

* cited by examiner

*Primary Examiner*—Stephen W Jackson
*Assistant Examiner*—Dharti Patel

(57) ABSTRACT

An apparatus for administering an incapacitating electric shock to a person is provided, which comprises a portable power source, at least one pair of electrodes operatively associated with the power source and that are configured to deliver an electric shock to the person's body, a locking mechanism configured to secure the electrodes at a desired position on said person's body and a remote control capable of generating and transmitting a signal to the power source that triggers the electric shock. The apparatus is operable such that the remote control may trigger an electric shock in a single power source, or in a plurality of power sources.

7 Claims, 8 Drawing Sheets

REMOTE CONTROLLED LOCKING ELECTROSHOCK STUN DEVICE AND METHODS OF USE

CROSS REFERENCE TO RELATED APPLICATIONS

The present application claims the benefits of U.S. patent application Ser. No. 11/117,029 filed on Apr. 29, 2005, entitled "REMOTE CONTROLLED: LOCKING WRIST AND/OR ANKLE INCAPACITATING ELECTROSHOCK STUN BRACELET FOR PRISONER CONTROL" and U.S. patent application Ser. No. 11/294,205 filed on Dec. 6, 2005, entitled "LOCKING MECHANISM FOR USE WITH RATCHET OR COG STRAP," The contents of each application are incorporated herein in their entirety.

FIELD OF THE INVENTION

The present invention generally relates to devices and methods for administering an electric shock to a target. More specifically, embodiments of the present invention provide a fully automated, remote controlled power source for administering a non-lethal, pulsating, incapacitating electric shock to a person at a specific point of contact.

BACKGROUND OF THE INVENTION

In law enforcement it is often necessary for enforcement officers to be able to control persons under arrest when those persons are in public situations. For example, it is typical for enforcement officers to escort such persons into and out of a court of law, in order to ensure that such persons do not take any actions that may disturb the order of, or that may cause harm or danger to anyone in, the court. Heretofore, this kind of control has been accomplished in several different ways, ranging from dressing persons under arrest in brightly colored uniforms so as to alert others to such persons' presence, to placing them in handcuffs, shackles, and similar restraints in order to restrict their movement. Each of these efforts has been employed in order to assist the enforcement officers in their efforts of keeping the peace and maintaining the safety in a courtroom, however, they are all visually obvious to those in the courtroom, which has raised concerns about maintaining a person's innocence to and through trial, as such a visual display of incarceration may have an impact on the opinions of jury members, reporters, and members of the public as to whether those persons are innocent or guilty.

A further concern exists as to the methods of control that may be used by enforcement officers when the need to control a person under arrest arises in public situations. For example, it is often unnecessary for such officers to utilize deadly force to control a person under arrest, making the use of firearms undesirable in many instances where control is necessary, especially when in a crowded public area. Other conventional weapons, such as clubs, pepper spray and Taser-type electroshock weapons, which are effective means of control in many situations, are wholly dependent upon the skill of the person using them and may also be impractical or impossible to use in certain crowded public situations. Moreover, the officer using these other conventional weapons must be relatively close to the person under arrest in order for them to be effective, which presents a danger that they will be taken away from, and used against, the officer or turned on a member of the public. Additionally, it may become necessary for an enforcement officer to physically overpower a person under arrest in order to regain control over that person, which can result in injuries to that person that are unintended by the officer, as well as injuries to the officer and to bystanders, all as unintended effects of the need to physically overpower such a person.

An additional challenge for law enforcement officers arises when transporting large numbers of persons under arrest to and through public areas. There is a need to maintain control over each of these persons during transport, but it is often undesirable or impractical to have an equal number of guarding officers as persons being transported. It thus becomes necessary for one officer to maintain control over several such persons for the entirety of the time of transport, so that they do not present a danger of escape or harm to each other, the officers, or the public at large. Similar control problems as those described above can arise in these situations, as it may be impractical to place each person in restraints or brightly colored uniforms, and it may be impossible for the outnumbered officers to maintain control of these persons in the event the same becomes necessary.

SUMMARY

What is needed is a means by which an individual under arrest, or a large number of individuals under arrest, may be non-lethally controlled by law enforcement officers while in public situations, while allowing that person, or persons, to maintain their Constitutional presumption of innocence when in a court of law or in public locations. It is also necessary to achieve a means by which such persons can be controlled and pacified quickly, effectively and in a non-lethal way in public situations, without providing the ability for those persons to remove the means of control and use it against a law enforcement officer or a member of the public. Such means should also provide a means by which a small number of law enforcement officers may, simultaneously and non-lethally, control a large number of persons under arrest without placing themselves or members of the public at risk of harm.

It is therefore an object of the present invention to provide a fully automated, remote controlled power source for administering a non-lethal, pulsating, incapacitating electric shock to a person at a specific point of contact, in combination with a remote control radio transmitter that is operable to deliver an operational signal to the power source to trigger the electric shock. In some embodiments, the power source is a single, small unit capable of being placed directly onto the body of a wearer in any number of discreet areas, such as the wrist, ankle, upper arm, or other areas where it may be hidden beneath clothing. The power source includes a locking mechanism configured to hold the power source securely to the wearer at the desired location, which mechanism is incapable of being unlocked and removed without a key. In some embodiments, the power source is operable to deliver a low-level electric shock to the wearer, while in other embodiments, the power source is operable to deliver a high-level electric shock, and in still other embodiments, the power source is operable to deliver an electric shock that is in between the former levels. The electric shock delivered by the power source is therefore sufficiently scalable so as to be configured to deliver any voltage to the wearer from approximately 40,000 volts up to approximately 80,000 volts. In all embodiments, the power source is configured to deliver an electric shock that is sufficient to immobilize the wearer, even through layers of clothing such as socks or shirt sleeves, without being lethal.

In some embodiments, regardless of the level of electric shock produced, the power source is configured to deliver the electric shock to the wearer through two electrodes located on the back side of the power source, which are placed into direct contact with the wearer. When activated by the remote control, an incapacitating electric shock is delivered to the wearer through these electrodes. In order to be activated by the remote control, the power source contains a radio receiver configured to receive a specific set of distinct radio signals transmitted by the remote control radio transmitter, such as a coded on/off power activation signal and a coded shock activation signal. In order to deliver the shock to the wearer at the desired time, the power source also contains an electrical circuit operably connected to the radio receiver, configured such that when a coded shock activation signal is received by the power source, the electric circuit is completed through the body of the wearer, and the shock delivered.

The remote control radio transmitter of the present invention is, in some embodiments, an electronic (battery operated) power source used for the remote operation of the power source. According to some aspects of the present invention, the remote control radio transmitter is a small, wireless handheld transmitter with an array of buttons that is used to issue a plurality of distinct radio frequency commands from a distance, such as a coded on/off power activation signal and a coded shock activation signal. The signals generated and transmitted by the remote control radio transmitter are specific, distinct radio frequencies emitted from a point of transmission to one or more power sources located within the operable distance of the transmitter. The remote control is operable to generate and send a plurality of distinct radio frequency commands to a singe power source, or to multiple power sources at once, thereby providing the user with the means of delivering a shock activation signal to a single power source, or to multiple power sources at a single time.

Also in some embodiments, the power source includes a banded, magnetically operated, locking mechanism with a ratchet or cog band that serves to hold the power source in place at the desired location on the wearer. In that regard, the locking mechanism also serves to hold the electrodes securely in place and ensures sufficient contact with the wearer for delivery of the shock. As described in greater detail below, the locking mechanism features a pawl that, when engaged, is held in place at any one of a plurality of locations along a ratchet or cog band by a plurality of magnets and which serves to restrict the motion of the band in a direction that would loosen it from the wearer's body. The pawl is automatically activated when the band is inserted into the appropriate location in the power source and remains activated until such time as a key of the proper configuration is inserted into the power source and turned in such a way so as to release the magnets holding the pawl in place, thereby releasing the locking mechanism.

DETAILED DESCRIPTION

Figure 1:
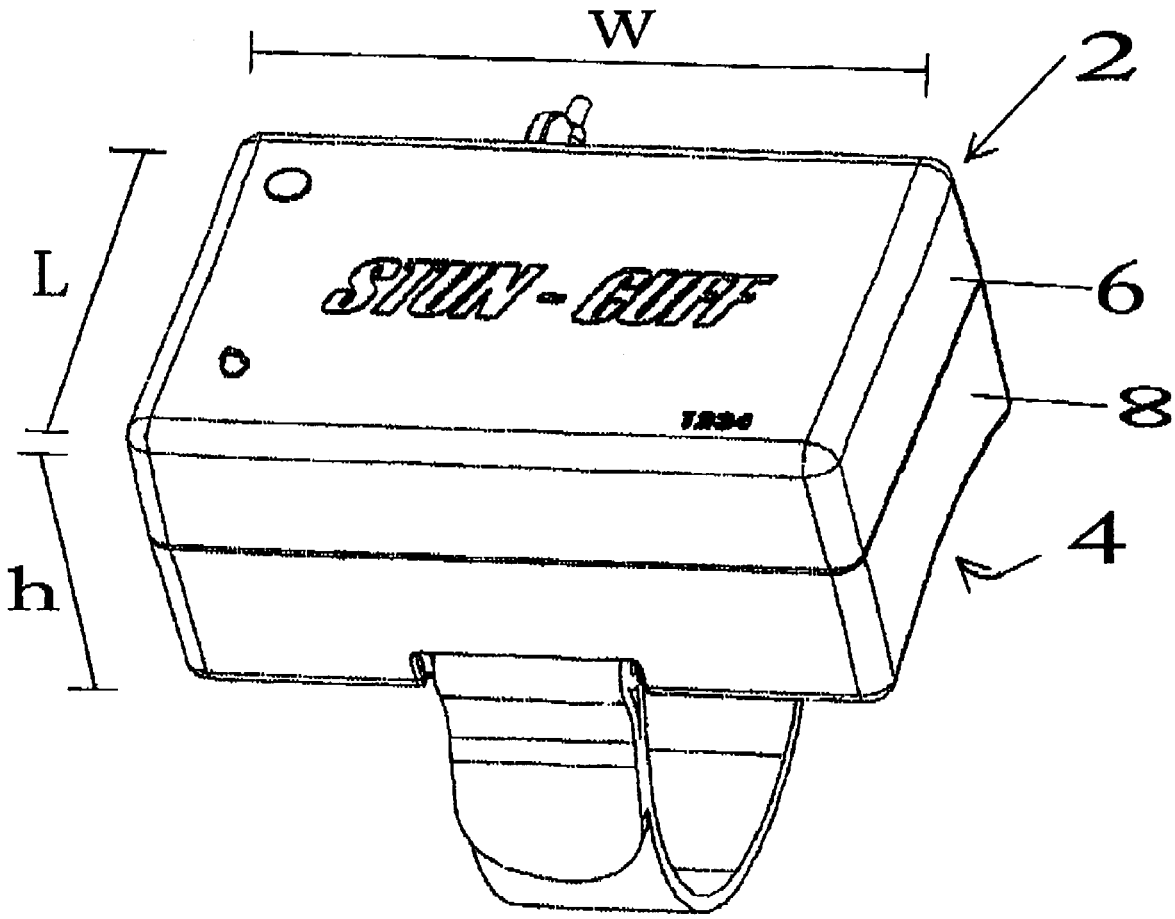
FIG. 1 is a perspective view of a power source for administering a non-lethal, pulsating, incapacitating electric shock to a person, in accordance with at least some embodiments of the present invention.

Referring initially to FIG. 1, a fully automated, remote controlled portable power source 2 for administering a non-lethal, pulsating, incapacitating electric shock to a person according to certain embodiments of the present invention is provided. The power source 2 is configured to be placed directly onto the body of a wearer in any number of discreet areas, such as the wrist, ankle, upper arm, or other areas where it may be hidden beneath clothing. Therefore, the power source 2 is preferably small enough in scale so as to fit over the hands and/or feet, and thereby be secured onto the ankles, arms, and/or wrists, of the average person, while remaining sufficiently low in profile so as to remain hidden under clothing, if so desired. In the presently preferred embodiment, the power source 2 has a length "L" of approximately 2 and 3/16 inches, a height "h" of approximately 1 and 5/8 inches, and a width "w" of approximately 3 and 3/16 inches and weighs less than about 16 ounces. As is apparent from FIG. 1, the bottom side 4 of the power source 2 is concave in shape so as to fit as closely as possible to the wearer and to place the electrodes (not shown in FIG. 1) in close contact with the wearer. The small size of the power source 2 of the present invention is advantageous to other power sources that presently exist to serve a similar purpose, in that the power source 2 may be located on the wearer's body at a location where it may be hidden underneath clothing; yet, the power source 2 of the present invention is capable of generating an electric shock of equal or greater magnitude than presently available power sources of larger size, which is quite advantageous. Therefore, the power source 2 allows the wearer to enter a public situation in street clothes, thereby reducing the probability that his or her appearance will impact the opinions of members of the public as to whether the wearer is innocent or guilty, while also allowing law enforcement officers to have the level of control over the wearer that may be necessary to maintain the order and safety of the public location in question.

Figure 2:
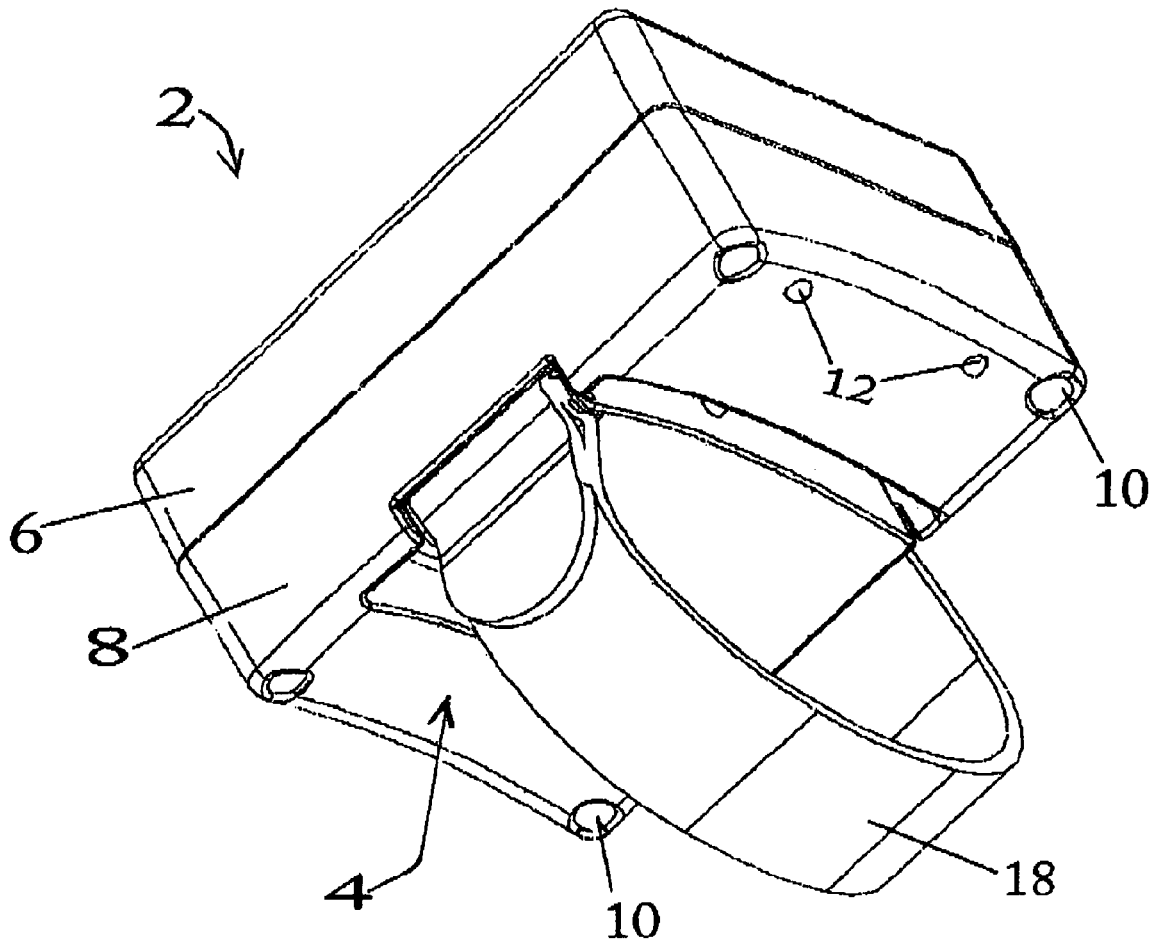
FIG. 2 is a bottom-side perspective view of the power source depicted in FIG. 1.

In the depicted embodiment, the power source 2 is encased within a hollow shell, which has a top half 6 and a bottom half 8. The shell encloses the means by which the power source 2 receives radio signals from the remote control radio transmitter and the means by which the power source 2 generates and delivers an electric shock to the wearer, making it necessary for the shell of the power source 2 to separate into two halves: to facilitate the performance of routine maintenance. Because of this, it is necessary for the top half 6 and the bottom half 8 to be configured so as to be securely connected to each other when worn by a person, thereby preventing the wearer from being able to separate the top half 6 from the bottom half 8 and disable the power source 2. As shown in FIG. 2, the bottom side 4 of the bottom half 8 has means 10 by which the top half 6 may be securely fastened to the bottom half 8. The means may be any number of ways in which the two halves may be securely fastened together, such as rivets and nails. In the presently preferred embodiment, the means 10 for securely fastening the two halves together is four screws, one at each corner of the bottom side 4 of the power source 2. The hollow shell must be sufficiently strong so as to protect the inner structures of the power source 2 during use and normal operation and is preferably constructed of a material that is sufficiently sturdy, impact-resistant, and water-resistant, such as metal, and even more preferably a rigid, high-impact plastic. This type of material is also such that the power source 2 may be cleaned and sanitized between uses, in the event that a power source 2 is worn by separate people in succession.

The purpose of the power source 2 is to deliver an electric shock to the wearer upon receipt of an appropriate signal from a remote control radio transmitter. The power source 2 delivers the electric shock to the wearer through two electrodes 12 located on the bottom side 4 of the power source. In this regard, but not portending to be limited in any manner, the following U.S. patents are incorporated herein by reference to assist in providing a written description of how the power source 2 may generate and deliver an electric shock to the wearer through the electrodes 12 and therefore how one of skill in the art may implement one or more embodiments of the present invention: U.S. Pat. No. 4,200,809 to Madsen, U.S. Pat. No. 4,120,053 to Rhoads et al., U.S. Pat. No. 4,943,885 to Willoughby et al., U.S. Pat. No. 5,207,178 to McDade et al., U.S. Pat. No. 5,146,207 to Henry et al., and U.S. Pat. No. 6,091,597 to Lin. The electrodes 12 are oriented along the concave surface of the bottom side 4 so that they are in direct contact with the wearer at all times, whether directly on the skin of the wearer or on the wearer's clothing. It is therefore an object of the present invention for the power source 2 to be able to deliver an electric shock to the wearer through clothing; the power source 2 need not be in direct contact with the wearer's skin to be effective. The proper amount of contact is achieved and maintained by the belt 18 of the power source 2, which serves to secure the power source 2 to the wearer and thus retain the electrodes 12 in the proper position along the body of the wearer so as to be able to deliver a sufficiently disabling electric shock to the wearer.

Figure 3:
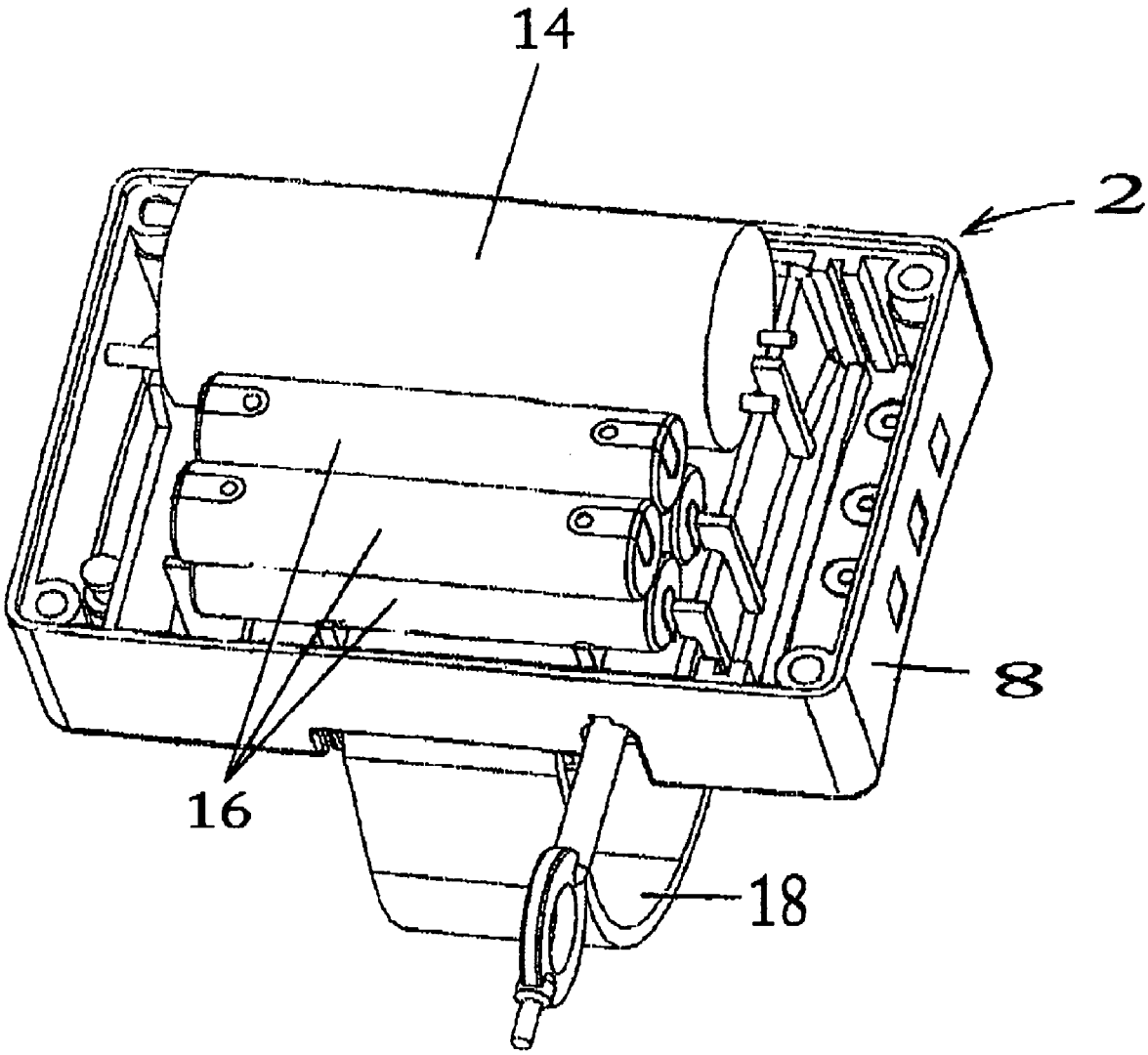
FIG. 3 is an internal perspective view of the power source depicted in FIG. 1.

Referring now to FIG. 3, a power source 2 in accordance with certain embodiments of the invention is presented, with the top half 6 removed to show the interior structures. In order to deliver the shock to the wearer at the desired time, the power source 2 contains an internal electrical circuit 14 capable of generating a temporary, repeatable, high-voltage, low-current electrical discharge that is delivered to the wearer via the electrodes 12. In the presently preferred embodiment, the current supplied by the power source 2 is relatively low due to the limitations of the electrical power supply 16, which is four standard "AA" type batteries in the preferred embodiment, and the power source 2 is thus not operable to deliver a fatal shock to the wearer. However, the power supply 16 is sufficiently strong so as to be able to deliver a high-voltage shock that is capable of causing pain and temporary paralysis to the wearer of the power source 2. The electrical circuit 14 may be of any kind capable of achieving the desired high-voltage, low current output, such as an oscillator-resonant circuit coupled with a step-up transformer, a diode-capacitor voltage multiplier, or similar electrical circuit. In the presently preferred embodiment, the electrical circuit is operable to administer the shock to the wearer in a series of intermittent (pulsatile), low amperage, low current, high voltage shocks, each of short duration, such as 2-3 seconds. The shocks may be repeatedly delivered to the wearer by the power source 2 in approximately ten second intervals, for so long as the electrical power supply 16 is capable of generating sufficient power to deliver a shock.

It is also an object of the present invention for the power source 2 to be configured to deliver electric shocks across a wide range of voltages. Therefore, in some embodiments the electrical supply 16 of the power source 2 is configured to be able to generate and deliver a relatively low-voltage electric shock, such as approximately 40,000 volts, to the wearer through the electrodes 12. In other embodiments, the electrical supply 16 of the power source 2 is configured to deliver a relatively high-voltage electric shock, such as approximately 80,000 volts, and in still other embodiments, the electrical supply 16 is configured to deliver an electric shock of intermediate voltage, such as approximately 60,000 volts. Therefore, the presently preferred embodiment of the power source 2 includes an electrical supply 16 capable of generating one, or all, of the aforementioned electrical discharges and the power source 2 is sufficiently scalable so as to be configured to deliver any of the same.

In many embodiments of the present invention, the power source 2 is configured to deliver an electric shock that is sufficient to immobilize the wearer, even through layers of clothing such as socks or shirt sleeves, without being lethal. The electrical discharge delivered by the power source 2 causes the wearer's nervous system to experience a brief, temporary failure, which results in a contemporaneous temporary paralysis of the skeletal muscles for so long as the shock is applied to the wearer. This paralysis manifests itself as the wearer's muscles twitching uncontrollably, as if in spasm. The wearer will also experience severe pain from the electrical discharge generated by the power source 2. Notwithstanding these symptoms, the wearer will experience a complete recovery in approximately ten minutes after delivery of the shock, with the wearer able to fully regain control of his or her body. As can be appreciated, by simultaneously delivering pain and causing temporary paralysis, the power source 2 can completely immobilize the wearer virtually instantly, allowing law enforcement officers the regain control of such wearer quickly and efficiently, with no harm done to the officers or to any member of the public that may be close to the wearer of the power source 2. Additionally, as will be explained further below, because the power source 2 is operated by remote control, immobilization of the wearer can be achieved by a law enforcement officer from a distance, thereby allowing the officer to prevent escape and other situations where a person under arrest may attempt to generate distance between himself or herself and the officer.

Figure 4:
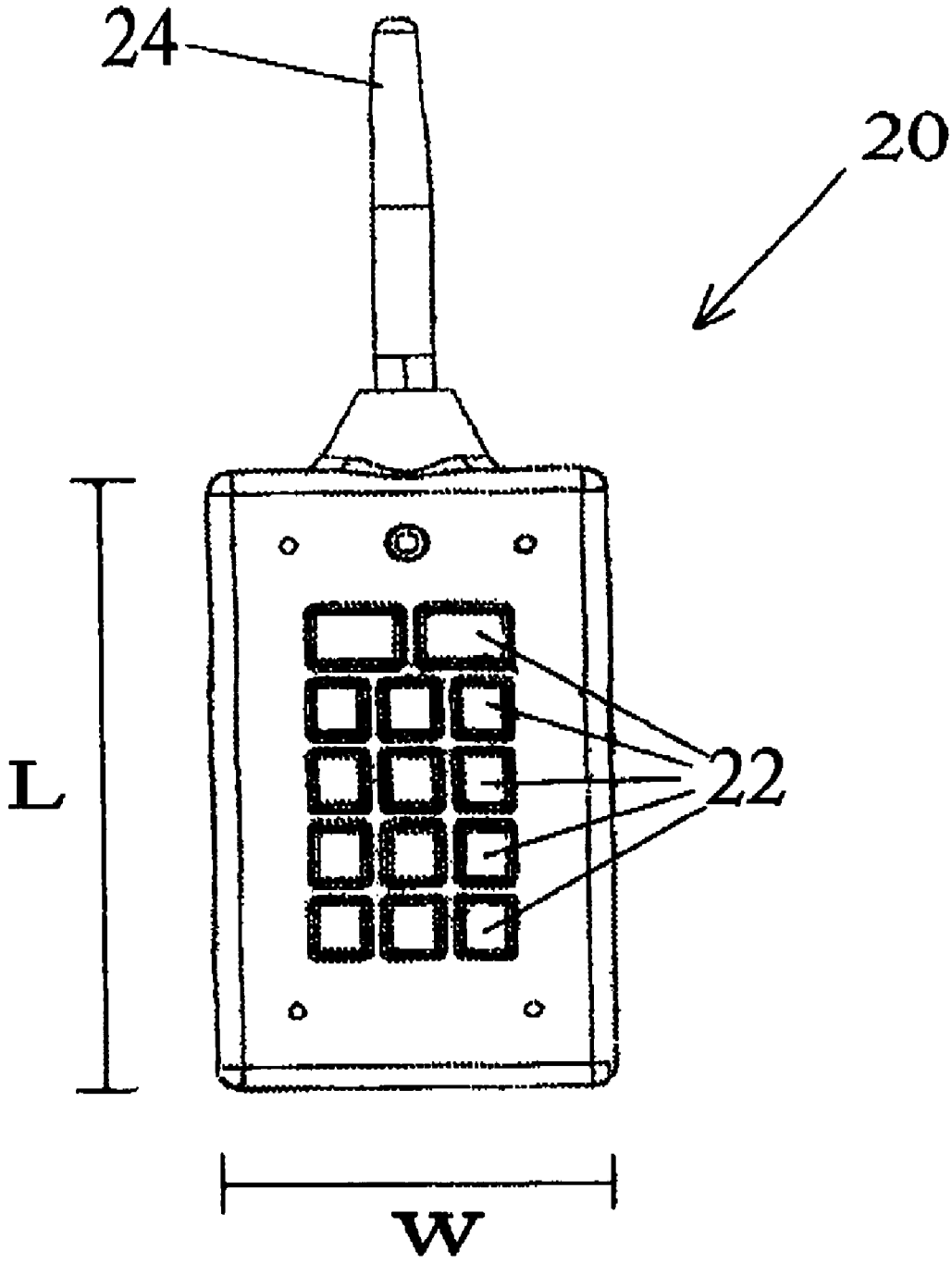
FIG. 4 is a perspective view of a remote control radio transmitter in accordance with at least some embodiments of the present invention.
Figure 5:
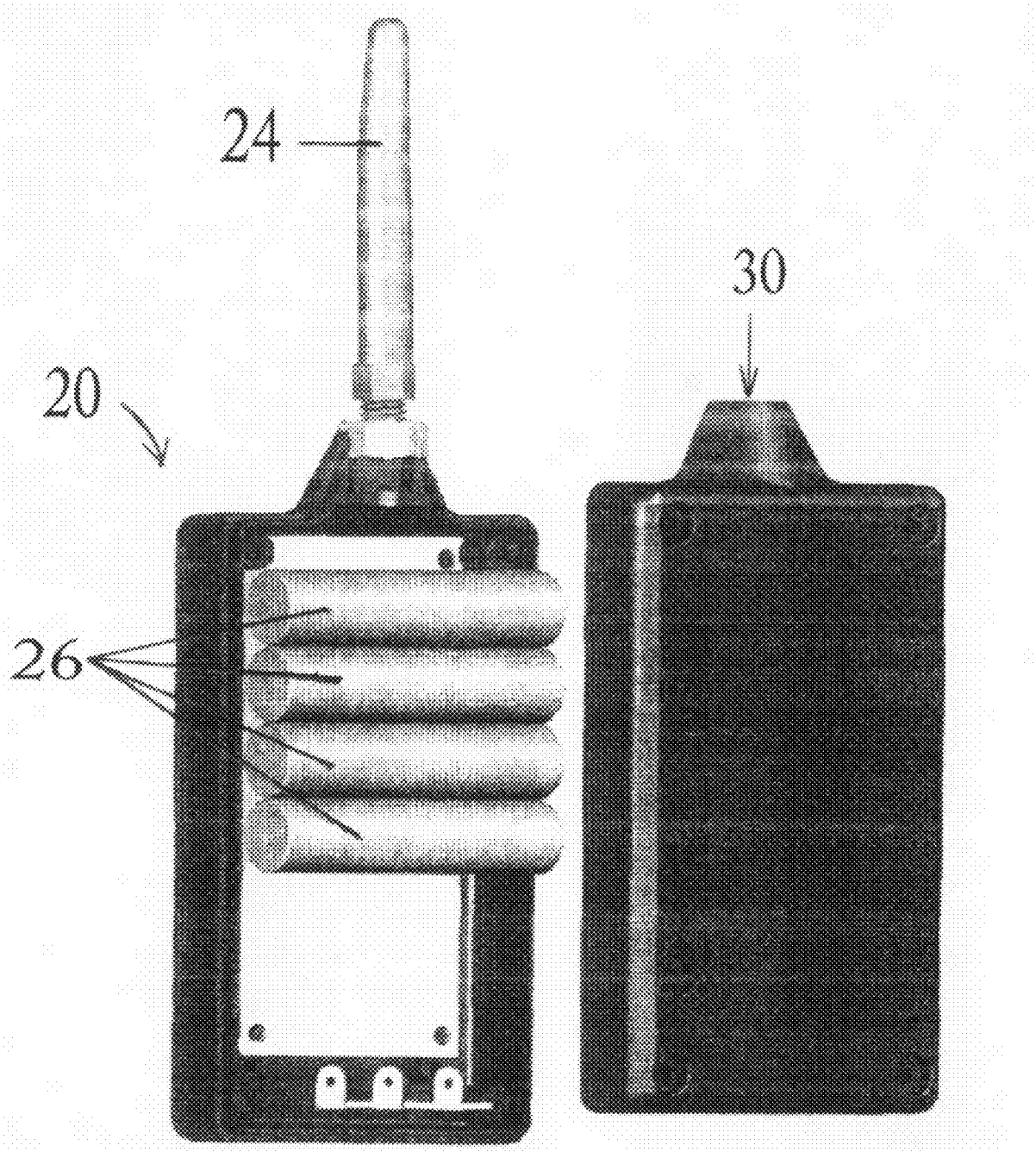
FIG. 5 is an internal perspective view of the remote control radio transmitter depicted in FIG. 4.
Figure 6:
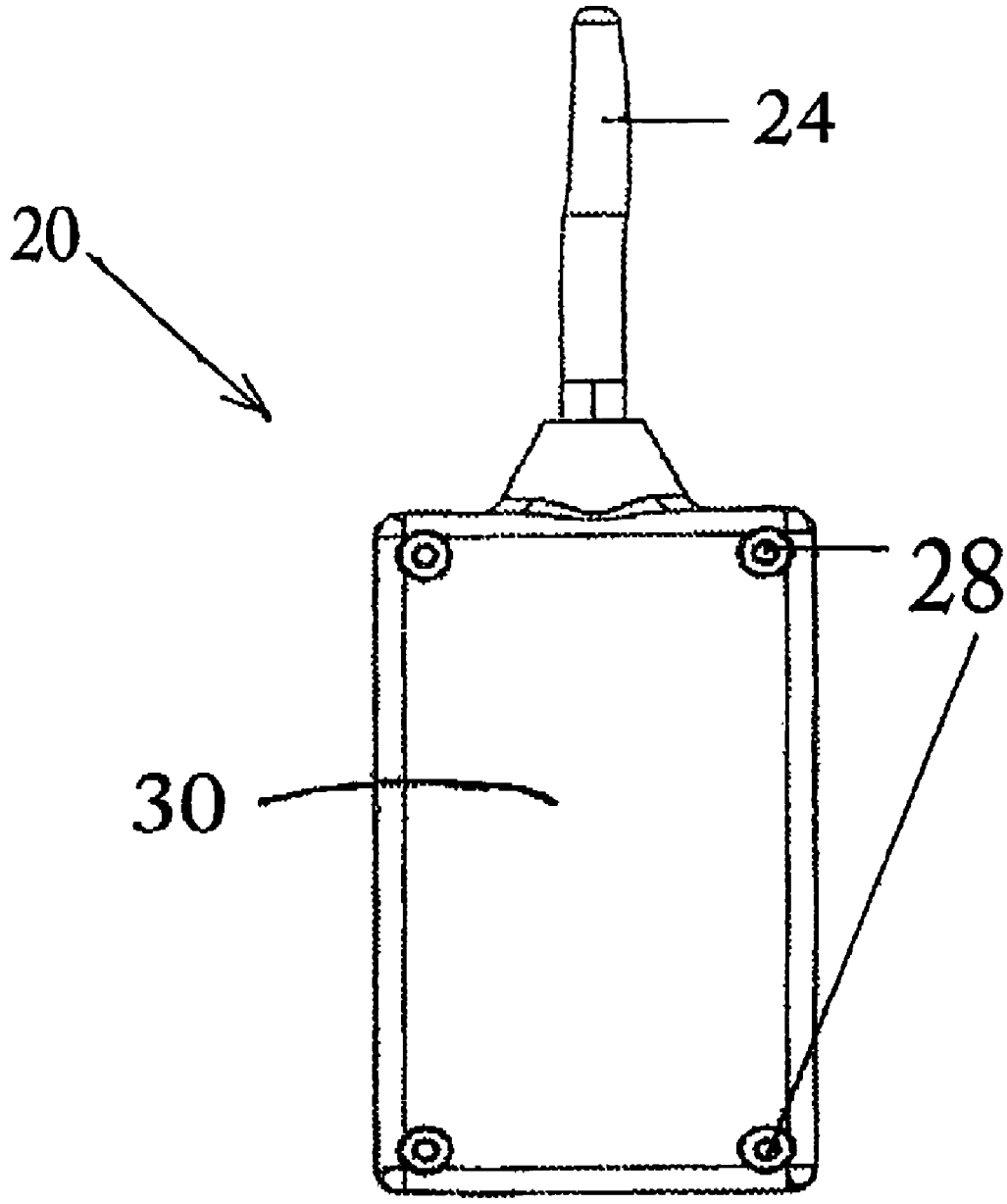
FIG. 6 is a perspective view of the back side of the remote control radio transmitter depicted in FIG. 4.

Referring now to FIG. 4, a remote control radio transmitter 20 in accordance with some embodiments of the present invention is presented. The transmitter 20 is a small, handheld, electronic (battery operated) device that is used to remotely operate the power source 2, thereby enabling an operator of the transmitter 20 to discharge an electric shock to the wearer of a power source 2 from anywhere within the functional range of the transmitter 20. In the depicted embodiment, the transmitter 20 is small, with a width "w" of approximately 1 and ⅞ inches and a length "L" of approximately 3 and 5/16 inches, and is intended for handheld use by an operator. The transmitter 20 also includes an array of buttons 22 that are used to encode and issue a plurality of distinct radio frequency commands, such as a coded on/off power activation signal and a coded shock activation signal, to one power source 2, or to a plurality of power sources 2, from a distance. The transmitter 20 is powered by an array of standard "AA" batteries 26, which are inserted into the transmitter 20 as shown in FIG. 5. As shown in FIG. 6, the transmitter 20 contains a back side 30 that is configured to be removed to facilitate insertion of the batteries, and that has means 28 by which the back side 30 may be securely fastened to the transmitter 20. The means 28 may be any number of ways in which two objects may be securely fastened together, such as rivets, nails and adhesives. In the presently preferred embodiment, the means 28 for securely fastening the back side 30 to the transmitter 20 is four screws, one at each corner of the back side 30 of the transmitter 20. The shell of the transmitter is preferably constructed of a material that is sufficiently sturdy, impact-resistant, and water-resistant so as to protect the inner workings of the transmitter 20 during normal use, such as metal, and even more preferably a rigid, high-impact plastic.

The transmitter 20 is operable to generate and send a plurality of distinct radio frequency commands from across a wide range of radio frequencies. These frequencies may be received and recognized by a single power source 2, or by a plurality of power sources 2 at once, thereby providing an operator with the means of controlling a plurality of power sources 2 at once, from a single transmitter 20. The signals generated and transmitted by the remote control radio transmitter 20 are specific, distinct radio frequencies that are directionally emitted from a point of transmission 24 to any power sources 2 located within the operable distance of the transmitter 20. In this regard, but not portending to be limited in any manner, the following U.S. patents are incorporated herein by reference to assist in providing a written description of how the transmitter 20 may generate and deliver a plurality of distinct radio frequencies to a target that is capable of receiving and interpreting them, and therefore how one of skill in the art may implement one or more embodiments of the present invention: U.S. Pat. No. 6,100,806 to Gaukel and U.S. Pat. No. 6,486,777 to Clark. Generally, the transmitter 20 of the present invention is configured to employ either pulse width modulation, pulse position modulation, spread spectrum technology or any other means of signal generation in order to generate and deliver a plurality of coded radio signals. In this regard, an operator of the transmitter 20 uses the array of buttons 22 to input data into the transmitter 20, which then selectively generates a radio signal of a specific channel type based on such input. Once it is generated, the signal is propagated outward from the transmitter 20 via the point of transmission 24, where it may be received by any number of power sources 2 that are within the transmitter's 20 range of transmission. Each power source 2 is configured to only respond to a specific set of radio frequency signals; no other radio signals will be effective to trigger operation of the power source 2. If the signal propagated by the transmitter 20 matches the frequency a power source 2 has been programmed to receive and respond to, then the power source 2 responds according to the signal. For example, if a power source 2 receives a coded on/off signal from the transmitter 20 that matches the frequency the power source 2 has been configured to receive, the power source 2 will respond by turning on or off, as appropriate. Additionally, if a power source 2 receives a coded activation signal from the transmitter 20 that matches the frequency the power source 2 has been configured to receive, the power source 2 will respond by delivering an electric shock to the wearer. The power source 2 may use any number of means to receive signals of this type, such as radio receivers coupled to integrated decoder circuits or Johnson counter circuits that are capable of receiving an output signal from the transmitter 20 and comparing that signal with the configuration of the power source 2. Such a circuit will not produce a response in the power source 2 unless the signal received matches the frequency input the power source 2 is configured to receive. Only when a match is obtained will the power source 2 generate the desired response, such as activation and/or generation and delivery of an electric shock to the wearer of the power source 2. In operation, an operator of the remote control radio transmitter 20 uses the array of buttons 22 to send one or more specific signals to one or more power sources 2 located within the transmitter's 20 range of transmission. The range of transmission is typically limited in size by the strength of the internal circuitry of the transmitter 20. In the presently preferred embodiment, the range of transmission is approximately 100 yards.

In order to be able to operate a single power source 2 using the remote control radio transmitter 20, and to thereby enable the operator to control a single person via the power source 2, the transmitter 20 must be configured to selectively generate and deliver those distinct radio frequency commands recognized by the power source 2 in question. As previously mentioned, the integrated radio receiver and decoder circuits of each power source 2 are configured to receive and respond to very specific radio frequency signals and therefore that power source 2 will only operate (e.g. turn on or off, and/or deliver an electric shock) when a signal matching one of the power source's 2 specific radio frequencies is received, no other radio frequencies will cause the power source 2 to operate. In order to configure the transmitter 20 to generate and deliver the specific radio frequencies receivable by a power source 2, an operator of the transmitter 20 uses the array of buttons 22 to input information specific to that power source 2 into the transmitter 20. For example, presume that the power source 2 in question has a four-digit code or serial number engraved into its exterior that represents at least one specific radio frequency signal that will cause the power source 2 to operate, which the transmitter 20 is capable of generating. The operator inputs this code or serial number into the transmitter 20 via the array of buttons 22, at which point the transmitter 20 becomes capable of generating and sending the specific radio signal(s) that will cause the power source 2 in question to operate. To facilitate delivery of this specific radio frequency signal, the transmitter 20 may be configured to receive the code or serial number as it is input and store it in a memory so that it need not be entered again, but rather the specific power source 2 can be activated by the pressing of a few buttons 22. This will allow the operator to be able to cause the transmitter 20 to generate and deliver the power source's 2 signal with as few button 22 strokes as possible (e.g. one or two), thereby enabling the operator to control the wearer of the power source 2 as quickly as possible. By way of example, presume that the array of buttons 22 is configured like a telephone key pad, with each button 22 containing a single number (e.g. 0-9). When the operator enters the four-digit code or serial number of the power source 2 in question into the transmitter 20, the transmitter's 20 memory may be configured to correlate that power source's 2 code or serial number with a single number, such as "1." This way, the operator of the transmitter 20 may cause the transmitter 20 to deliver a signal to the power source 2 in question with a single key stroke, such as by depressing "1." To prevent accidental signal transmission, and therefore accidental shock delivery, it may be desirable for the transmitter 20 to be configured to require more than one keystroke before transmitting the coded signal to deliver an electric shock, such as a specific sequence of two or three keystrokes. Alternatively, the operator may elect to configure the transmitter 20 so that it will not transmit a signal until the power source's 2 code or serial number is entered in its entirety. It is therefore an object of the present invention that the transmitter 20 be sufficiently programmable so as to enable the operator of the transmitter 20 to be able to configure the number of keystrokes necessary for the situation at hand.

It is another object of the present invention for the transmitter 20 to be operable to control a plurality of power sources 2, either one at a time or all at once. In the presently preferred embodiment, the transmitter 20 may be configured to control up to nine different power sources 2, each of which is capable of responding to different radio frequencies, though the present invention is sufficiently scalable to enable the control of a larger number of power sources 2, one at a time, via a single transmitter 20. It is also an object of the present invention for a plurality of power sources 2 to each be configured to respond to the same distinct coded radio signal, thereby enabling an operator of a single transmitter 20 to send the same coded activation signal to a plurality of power sources 2 at a single time. These embodiments provide a great advantage to the operator of the transmitter 20 in that a large number of persons, each wearing his or her own unique power source 2, may be controlled in a public environment by a single transmitter 20 operator using only a single transmitter 20 of the present invention. For example, the single operator may cause a single power source 2 to deliver an electric shock to its wearer, without activating the remaining power sources 2 in the group of people, or the operator may activate all of the power sources 2 present in the group of people, thereby delivering an electric shock to the entire group simultaneously. In order to accomplish this, the transmitter 20 and each power source 2 out of a plurality of power sources 2 must be configured to operate in this manner. When entering the four-digit codes or the serial numbers of each power source 2 in the group into the transmitter 20, the operator may utilize the transmitter's 20 memory to correlate the first power source's 2 code or serial number with a single number, such as "1," as before. Additionally, the operator may correlate the second power source's code or serial number with "2," and so on until all of the power sources 2 present in the group have been entered into the transmitters' 20 memory, or until the memory capacity of the transmitter 20 has been reached (at which time a second transmitter may be employed in an identical manner). This way, the operator of the transmitter 20 may cause the transmitter 20 to deliver a signal to an individual power source 2 with a minimal number of keystrokes, such as by depressing "1" for the first power source 2 programmed, "2" for the second power source 2 programmed, and so on. As with the previous embodiment, to prevent accidental signal transmission, and therefore accidental shock delivery, it may be desirable for the transmitter 20 to be configured to require more than one keystroke before transmitting the coded signal to deliver an electric shock, such as a specific sequence of two or three keystrokes. Therefore, the transmitter 20 may generate and deliver an electric shock to each power source 2 independently, via the use of separate radio signals, so that one person present in a large group of persons may be controlled via the delivery of an electric shock from the single transmitter 20, without the operator shocking any of the remaining persons in the group. Additionally, in the event that the entirety of the group of persons needs to be controlled at one time, these embodiments also allow for the transmitter 20 to generate and deliver a coded radio signal that is common to every power source 2 present in the group and that causes every power source 2 within the effective range of the transmitter 20 to generate and deliver an electric shock. When entering the four-digit codes or the serial numbers of each power source 2 in the group into the transmitter 20, the operator may not only utilize the transmitter's 20 memory to correlate the first power source's 2 code or serial number with a single number, such as "1," the second with "2," and so on, but may also use the transmitter's memory to correlate every power source 2 entered to a single number, such as "0." In other words, the first power source 2 is correlated with "1" and also correlated with "0," the second power source 2 is correlated with "2" and "0," and so on. This way, the operator of the transmitter 20 may cause the transmitter 20 to deliver a signal to individual power sources 2 as before, but also to every programmed power source 2 at once with a minimal number of keystrokes, such as by depressing "0." Also as before, it may be desirable for the transmitter 20 to be configured to require a unique sequence of two or three keystrokes before sending this group signal, to ensure that it is not sent accidentally. As can be appreciated, this embodiment allows for the efficient control of several persons under arrest by a single transmitter 20 operator, while also providing the security that may be required in the event that all such persons under arrest require control at the same time.

It is a further object of the present invention that the power sources used for the power source 2 and the transmitter 20, 16 and 26 respectively, be rechargeable, thereby enabling operation over an extended period of time. In the presently preferred embodiment, then the power sources 16 and 26 would be rechargeable "AA" type batteries. In that regard, in some embodiments both the power source 2 and the transmitter 20 may include means by which a person can tell when the power sources 16 and 26 are running low on power, such as a lighted display, a digital display, an audible alarm, or similar means.

Figure 7:
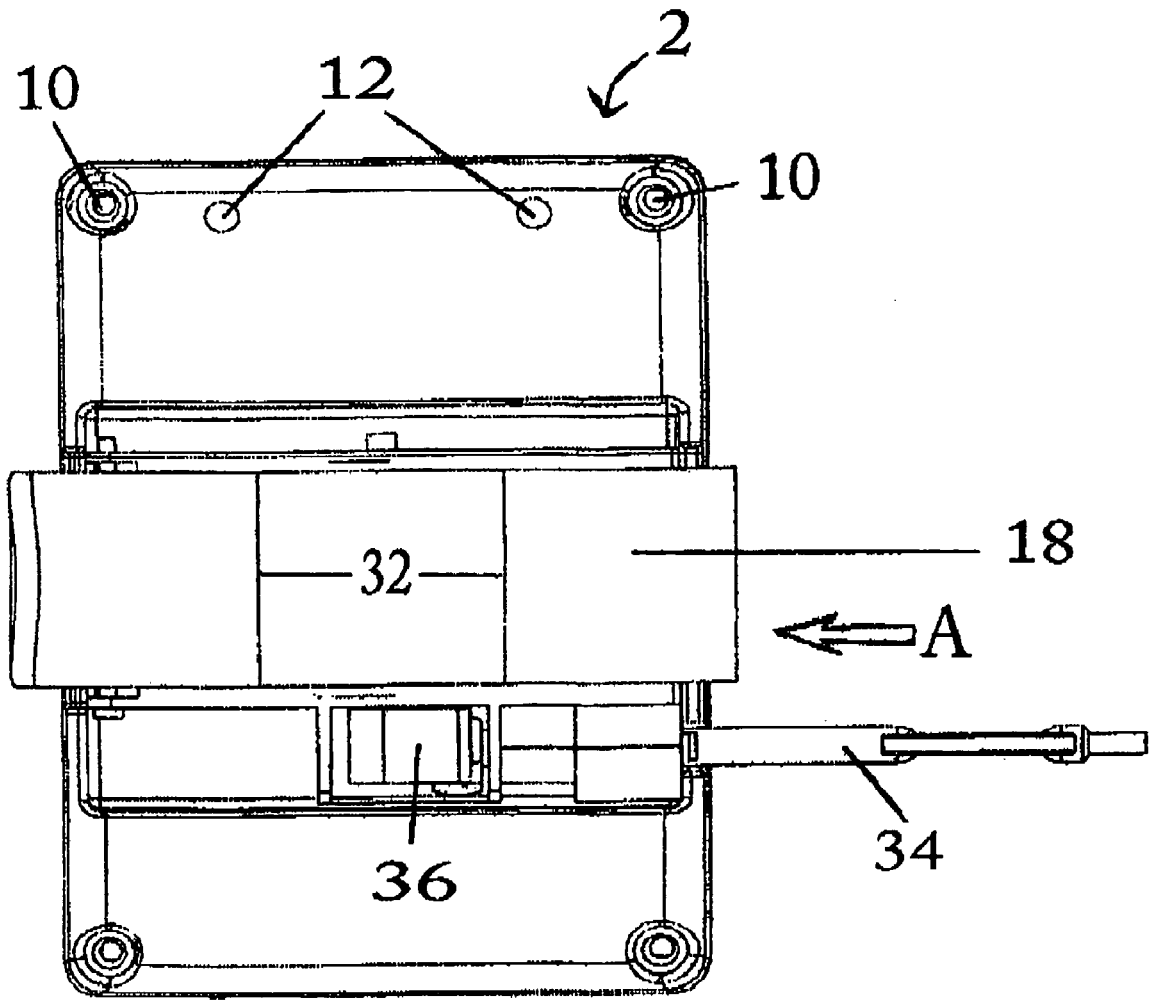
FIG. 7 is a perspective view of a locking mechanism in accordance with at least some embodiments of the present invention.
Figure 8:
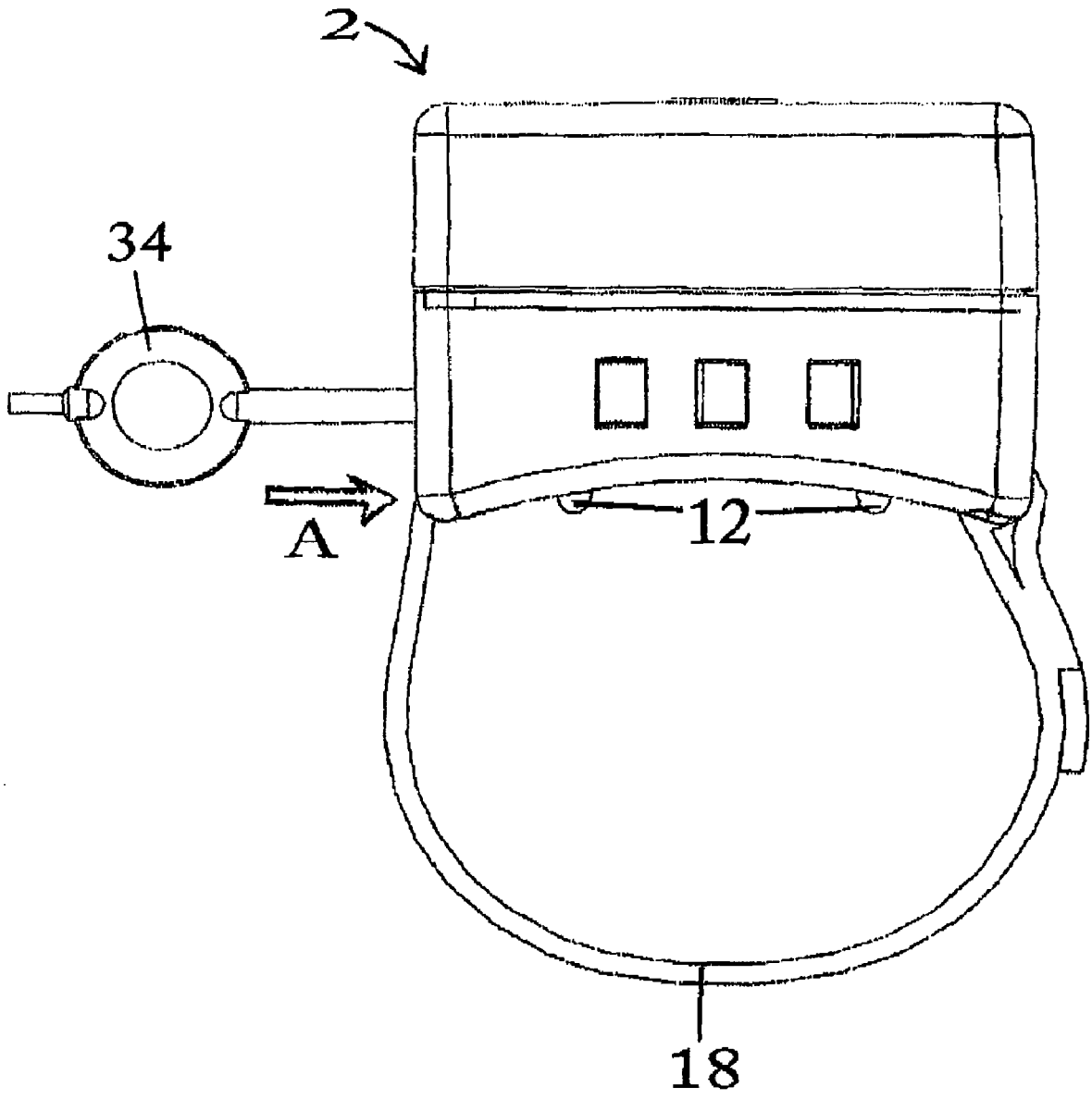
FIG. 8 is a side perspective view of the locking mechanism depicted in FIG. 7.

Referring now to FIGS. 7 and 8, a locking mechanism in accordance with certain embodiments of the present invention is presented. In the depicted embodiment, the locking mechanism includes a band 18, capable of being tightened to a plurality of sizes, which serves to hold the power source 2 in place at the desired location on the wearer. In that regard, the band 18 also serves to hold the electrodes 12 securely in place against the wearer of the power source 2 or the wearer's clothes, thereby ensuring sufficient contact with the wearer for delivery of the electric shock. The locking mechanism is therefore preferably included with all embodiments of the power source 2 and it is intended that any number of appropriate locking mechanisms may be employed with the power source 2, such as a handcuff-style locks, shackles, and similar locking mechanisms. In the presently preferred embodiment, however, the locking mechanism is a ratchet that includes a pawl (not shown) that, when engaged, is held against the band 18 by a plurality of magnets (not shown). The band 18 is therefore preferably of a ratchet or cog configuration and includes a plurality of ridges or teeth 32 along its length that contact the pawl when the locking mechanism is engaged. In this regard, but not portending to be limited in any manner, the following U.S. patents are incorporated herein by reference to assist in providing a written description of how the present invention may be configured to create a key operated restraining device with a securing loop of adjustable dimension, and therefore how one of skill in the art may implement one or more embodiments of the present invention: U.S. Pat. No. 6,446,474 to Tabacci, et al. In the preferred embodiment, the ratchet mechanism of the locking mechanism generally works because the band 18 has triangular ridges or teeth 32 set off at an angle, and a metal pawl that rests against the band 18 when the locking mechanism is engaged. The teeth or ridges 32 are angled such that when the band 18 is inserted into the power source 2 in the direction of arrow "A," the pawl rises as it slides over the rise of each ridge or tooth 32 and then clicks down over the lip of each ridge or tooth 32 to the level of the band 18. Because of the triangular shape of the ridges or teeth 32, the pawl becomes located and abutted against a flat surface of the triangular ridge or tooth 32 and is prevented from moving back up over the lip of each ridge or tooth 32. The flat surface therefore prevents the band 18 from moving backward each time it clicks down over a ridge or tooth 32. Therefore, when engaged, the locking mechanism permits movement of the band 18 in the tightening direction only (e.g. in the direction of arrow "A"). If the band 18 is pulled backward against the direction of arrow "A," the pawl and the flat surface of the lip of the engaged tooth or ridge 32 will make contact, preventing any backward movement. To further ensure that the locking mechanism will be effective, the pawl is preferably constructed of a magnetic metal, such as iron, steel, cobalt, nickel or similar magnetic materials, and is configured to be held down against the band 18 (and thus in contact with a flat surface of the lip of the engaged tooth or ridge 32) by a plurality of magnets (not shown). When configured in this way, the magnets assist the pawl in clicking down over the lip of each ridge or tooth 32 and also serve to hold the pawl to the level of the band 18 when the locking mechanism is engaged. As can be appreciated, the magnets add strength and stability to the locking mechanism, thereby helping to ensure that the power source 2 is securely held onto, and against, the wearer for optimal delivery of the electric shock.

The pawl becomes automatically engaged when the band 18 is inserted into the power source 2 along the direction of arrow "A" and remains engaged until such time as a key 34 of the proper configuration is inserted into the power source 2 and turned in such a way so as to release the pawl from the magnets, thereby releasing the locking mechanism and allowing the band 18 to be loosened. In the preferred embodiment, the key 34 is a standard handcuff key of the type typically carried by law enforcement officers. When properly turned, the key 34 of proper configuration activates a release mechanism 36 inside of the power source 2. The release mechanism 36 is configured in such a way that, when the key 34 is not inserted in the power source 2, the release mechanism 36 is not in contact with the pawl and the locking mechanism is engaged with the band 18. When the key 34 is inserted into the power source 2 and properly turned, the key 34 causes the release mechanism 36 to raise the pawl to a height above the lip of each ridge or tooth 32, allowing the band 18 to be loosened and even removed from the power source 2. In some embodiments, the release mechanism 36 serves to break the magnetic attraction between the pawl and the plurality of magnets by moving the pawl away from the surface of the band 18. In other embodiments, the release mechanism 36 simultaneously moves the magnets away from the pawl as it moves the pawl away from the band 18 to a height above the lip of each ridge or tooth 32, thereby increasing the distance between the pawl and the magnets and reducing the attractive forces between the pawl and the plurality of magnets.

A method of controlling the actions of at least one person with the apparatus of the present invention will now be described according to embodiments of the present invention. In the first instance, a power source 2 is obtained and a desired location is established for location of the power source 2 on the person. For example, if the person has a need to be dressed in a suit or similar clothing, it may be advantageous to place the power source 2 on the person's ankle, so that the pants of the suit can cover it, making it appear as if the power source 2 is not present on the wearer. Alternatively, if the person is to wear a long sleeved shirt or jacket, then it may be desirable to place the power source 2 on the person's wrist, as it will still be covered by the person's clothing. Before securing the power source 2 on the person at the desired location, the operator of the transmitter 20 makes note of the code or serial number of the power source 2, and inputs such number into the transmitter 20 using the buttons 22 so that the operator may use the transmitter to control the power source 2. Thereafter, the operator of the transmitter 20 places the power source 2 on the person at the desired location, inserts the band into the power source 2 in the appropriate manner, and tightens the band 18 of the locking mechanism sufficiently to ensure that the concave bottom side 4 of the power source 2, and particularly the electrodes 12, are in contact with the skin of the person, or the person's clothing. The person is then escorted into a desired public area, or other area where control of that person via the power source 2 may be necessary.

In the event that the operator of the transmitter 20 only has a need to control a single person, and therefore only the need to transmit coded signals to a single power source 2, that operator may have elected to input the power source-specific code or serial number into the transmitter's 20 memory and then configure the transmitter's 20 memory to correlate the power source's 2 code or serial number with a single number, such as "1." This way, the operator of the transmitter 20 may cause the transmitter 20 to deliver a signal to the power source 2 with a single key stroke, such as by depressing "1." To prevent accidental signal transmission, and therefore accidental shock delivery, the operator may optionally configure the transmitter 20 to require more than one keystroke before transmitting the coded signal to deliver an electric shock, such as a specific sequence of two or three keystrokes including "1." In this instance, when the need to control the person arises, the operator of the transmitter 20 need not re-enter the power source 2-specific code or serial number, but may merely point the transmitter 20 toward the person (ensuring that the person is in range of the transmitter 20), and depress the button 22 or desired combination of buttons desired to transmit a coded signal to the power source 2. For instance, if the transmitter 20 was configured so that the operator need only depress a single button 22 in order to transmit a coded signal to the power source 2, then in this example the operator need only press "1" on the transmitter 20 to send a coded signal to the power source 2, which signal may turn the power source 2 on or off, or may cause the power source 2 to deliver an electric shock to the wearer. Alternatively, to avoid having the power source 2 deliver a shock due to an inadvertent pressing of a single button, the operator may have configured the transmitter 20 to require the operator to depress a specific combination of buttons 22, such as two or three specific buttons in sequence, before the coded signal will be transmitted. In this example, the operator may have configured the transmitter 20 to require the pressing of "1" and then another number, or vice versa. In the presently preferred embodiment, the transmitter 20 is configured to require a specific sequential depressing of at least two buttons 22. After the correct button sequence is entered into the array of buttons 22 on the transmitter 20, the transmitter 20 generates and delivers a signal that is specific to the power source 2, causing the power source 2 turn on or turn off, or causing the power source 2 to generate and deliver an electric shock to the wearer, thereby pacifying the wearer and bringing him or her within the control of the operator.

In the event that the operator of the transmitter 20 has a need to control multiple persons, each wearing his or her own unique power source 2, and therefore the need to transmit coded signals to a plurality of power sources 2, the operator may elect to input each of the power source-specific codes or serial numbers into the transmitter's 20 memory and then configure the transmitter's 20 memory to correlate each power source's 2 code or serial number with a single number, such that the first power source 2 is correlated with the number "1," the second power source 2 is correlated with the number "2," and so on. This way, the operator of the transmitter 20 may cause the transmitter 20 to deliver a signal to one specific power source 2 with a single key stroke, such as by depressing "1" to signal the first programmed power source 2, or by depressing "2" to signal the second programmed power source 2. To prevent accidental signal transmission, and therefore accidental shock delivery, the operator may also configure the transmitter 20 to require more than one keystroke before transmitting a coded signal to a specific power source 2 to deliver an electric shock, such as a specific sequence of two or three keystrokes. In this instance, when the need to control the person arises, the operator of the transmitter 20 need not re-enter the power source 2-specific code or serial number of each power source 2 and also need not remember each power source's 2 code or serial number, but may merely point the transmitter 20 toward the desired person (ensuring that the person is in range of the transmitter 20), and depress the button 22 or combination of buttons that causes the transmitter 20 to send a coded signal to the desired power source 2. For instance, if the transmitter 20 was configured so that the operator need only depress a single button 22 in order to transmit a coded signal to a desired power source 2, then in this example the operator need only press "1" on the transmitter 20 to send a coded signal to the first programmed power source 2, need only press "2" to send a signal to the second programmed power source 2, and so on. Each signal may turn a specific, desired power source 2 on or off, or may cause a specific, desired power source 2 to deliver an electric shock to the wearer. Alternatively, to avoid having the power source 2 deliver a shock due to an inadvertent pressing of a single button, the operator may have configured the transmitter 20 to require the operator to depress a specific combination of buttons 22, such as two or three specific buttons in sequence, before the coded signal will be transmitted. In the presently preferred embodiment, the transmitter 20 is configured to require a specific sequential depressing of at least two buttons 22. After the correct button sequence is entered into the array of buttons 22 on the transmitter 20, the transmitter 20 generates and delivers a signal that is specific to an individual power source 2, causing the power source 2 turn on or turn off, or causing the power source 2 to generate and deliver an electric shock to one specific wearer, thereby pacifying the wearer and bringing him or her within the control of the operator.

There may also be occasions where the operator of the transmitter 20 is charged with controlling multiple persons, each wearing his or her own unique power source 2, and that operator has a need to use the transmitter 20 to administer an electric shock to all such persons at one time. In this instance, each of the power sources 2 may be configured to respond to the same coded radio signal by the operator of the transmitter 20. In this instance, when entering the four-digit codes or the serial numbers of each power source 2 in the group into the transmitter 20, the operator may not only utilize the transmitter's 20 memory to correlate the first power source's 2 code or serial number with a single number, such as "1," the second with "2," and so on, but may also use the transmitter's memory to correlate every power source 2 entered to a single number, such as "0." In other words, the first power source 2 is correlated with "1" and also correlated with "0," the second power source 2 is correlated with "2" and "0," and so on. This way, the operator of the transmitter 20 may cause the transmitter 20 to deliver a signal to every programmed power source 2 with a minimal number of keystrokes, such as by depressing "0." As before, it may be desirable for the transmitter 20 to be configured to require a unique sequence of two or three keystrokes before sending this signal, to ensure that it is not sent accidentally. In the presently preferred embodiment, the transmitter 20 is configured to require a specific sequential depressing of at least two buttons 22. After the correct button sequence is entered into the array of buttons 22 on the transmitter 20, the transmitter 20 generates and delivers a signal that is generic to all of the power sources 2 in the group, causing every power source 2 turn on or turn off, or causing every power source 2 to generate and deliver an electric shock to every member of the group, thereby pacifying the entire group and bringing them within the control of the operator.

The present invention, in various embodiments, includes components, methods, processes, systems and/or apparatuses substantially as depicted and described herein, including various embodiments, subcombinations, and subsets thereof. Those of skill in the art will understand how to make and use the present invention after understanding the present disclosure. The present invention, in various embodiments, includes providing devices and processes in the absence of items not depicted and/or described herein or in various embodiments hereof, including in the absence of such items as may have been used in previous devices or processes, e.g., for improving performance, achieving ease and\or reducing cost of implementation.

The foregoing discussion of the invention has been presented for purposes of illustration and description. The foregoing is not intended to limit the invention to the form or forms disclosed herein. In the foregoing Detailed Description for example, various features of the invention are grouped together in one or more embodiments for the purpose of streamlining the disclosure. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the invention.

Moreover though the description of the invention has included descriptions of one or more embodiments and certain variations and modifications, other variations and modifications are within the scope of the invention, e.g., as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. An apparatus for administering an incapacitating electric shock to a person, comprising: a portable power source weighing less than 16 ounces; at least one pair of electrodes operatively associated with said power source, said electrodes configured to deliver a predetermined amount and duration of an electric shock to a person's body; a locking mechanism configured to secure the electrodes at a desired position on said person's body, said locking mechanism comprising a ratchet operatively associated with a band and a magnetic means for reversibly engaging a pawl with said band; a remote control at least comprising an array of buttons, a power source, and a means for generating and transmitting at least one specific radio signal; and wherein said power source is adapted to receive said at least one specific radio signal and in response thereto, subsequently generate a low current electric shock in the range of about 40,000 volts to 80,000 volts.

2. An apparatus for administering an incapacitating electric shock to a person, comprising: a portable power source capable of generating an electric shock in response to at least one specific radio signal; at least one pair of electrodes operatively associated with said power source, said electrodes configured to deliver said electric shock to said persons body; a locking mechanism configured to secure the electrodes at a desired position on said persons body, said locking mechanism comprising a ratchet operatively associated with a band and a magnetic means for reversibly engaging a pawl with said band; a remote control comprising at least an array of buttons, a power source, and a means for generating and transmitting the at least one specific radio signal; and wherein said power source is adapted to receive said at least one specific radio signal and in response thereto, subsequently generate an electric shock to said person's body.

3. The apparatus of claim 2, wherein the power source weighs less than 16 ounces.

4. The apparatus of claim 2, wherein the electrodes are further configured to deliver said electric shock to said person's body at a predetermined amount and duration.

5. The apparatus of claim 2, wherein the electric shock is a low current high voltage electric shock.

6. The apparatus of claim 2, wherein the electric shock is administered in the range of about 40,000 volts to 80,000 volts.

7. A method for administering an incapacitating electric shock to a person, comprising: providing a portable power source weighing less than 16 ounces wherein said power source is adapted to receive at least one specific radio signal and in response thereto, subsequently generate a low current electric shock in the range of about 40,000 volts to 80,000 volts; providing at least one pair of electrodes operatively associated with said power source, said electrodes configured to deliver said electric shock to said person's body; providing a locking mechanism configured to secure the electrodes at a desired position on said person's body, said locking mechanism comprising a ratchet operatively associated with a band and a magnetic means for reversibly engaging a pawl with said band; providing a remote control comprising an array of buttons, a power source, and a means for generating and transmitting the at least one specific radio signal; configuring the remote control to generate the at least one specific radio signal; securing the electrodes to the person's body by tightening the band of the locking mechanism onto the person's body; transmitting the at least one specific radio signal from the remote control to the power source; receiving the at least one specific radio signal at the power source; and administering the electric shock from the power source to the person in response to the at least one specific radio signal.

* * * * *